United States Patent [19]

Frank et al.

[11] Patent Number: 4,735,827

[45] Date of Patent: Apr. 5, 1988

[54] CLEAR COAT DEFINITION CONTROL

[75] Inventors: John W. Frank, Cottage Grove; Brian L. Koster, Mendota Heights, both of Minn.

[73] Assignee: Minnesota Mining and Manufacturing Company, St. Paul, Minn.

[21] Appl. No.: 846,754

[22] Filed: Apr. 1, 1986

[51] Int. Cl.[4] ..... B05D 3/02; B05D 5/00

[52] U.S. Cl. ..... 427/264; 427/265

[58] Field of Search ..... 427/264, 265, 266

[56] References Cited

U.S. PATENT DOCUMENTS 4,022,926 5/1977 Keough et al. ..... 427/265 X 4,409,264 10/1983 Gilleo et al. ..... 427/266 X

*Primary Examiner*—Evan K. Lawrence

*Attorney, Agent, or Firm*—Donald M. Sell; James A. Smith; Gerald F. Chernivec

[57] ABSTRACT

A process for preparing a graphic pattern on a carrier having a protective coating thereon in exact registration with the pattern, and the article produced thereby. The process comprises applying a liquid protective coating over the graphic pattern slightly beyond the edge definition of the pattern and in substantial registration therewith, the protective coating having sufficient surface tension to wet the graphic pattern, but not the surface of the carrier. When the protective coating is dried, it dewets and retracts from the surface of the carrier onto the graphic pattern and provides exact registration therewith.

8 Claims, No Drawings

CLEAR COAT DEFINITION CONTROL

TECHNICAL FIELD

This invention relates to a method for making a thin film graphic design article. More particularly, it relates to a method for making an article comprising a thin film graphic design having a protective coating thereover, with the protective coating having tapered edges, similar to paint.

BACKGROUND ART

On site application of paint directly to a surface to be decorated is the time-honored method for providing a graphic design, such as a decorative design. While such a process provides many aesthetic and physical features, including realistic appearance, color flexibility, durability to abrasion, weathering and chemical attack, it also suffers from many disadvantages. For example, relatively skilled labor is necessary. Long application times are usually the rule, and potential contamination to adjacent areas, particularly mechanical equipment, can occur. Accordingly, prefabricated film graphics have been utilized to avoid many of these disadvantages. Such film graphics, often called "decals" or "transfer graphics", when utilized on the exterior surface of vehicles, typically require extreme resistance to abrasion and chemical attack because of exposure of the vehicle surfaces to various atmospheres or environments. Accordingly, such graphics must generally be provided with a protective clear coat over the graphic areas.

This protective clear coat can be located in registry with the graphic area by applying a continuous layer of clear coat over the graphic and non-graphic areas, and subsequently cutting through the several layers precisely at the outline of the graphic area, typically called "die cutting" or "kiss cutting". This approach can result in considerable waste, and furthermore can require rather expensive cutting tools, particularly if intricate graphic designs are involved. Furthermore, the vertical or right angle edges of the graphic and protective clear coat can collect dirt, wax and other foreign materials which can detract from the aesthetics of the applied graphic design.

A second approach is to apply the protective clear coat only to graphic areas, as, for example, by screen printing, utilizing a stencil with an open area corresponding precisely to the outline of the graphic design. Those skilled in the art are aware of the difficulty encountered with such a process, because of factors such as dimensional changes in the film substrate, tension variables in the screen mesh, and accurate positioning of the substrate in registry with the stencil. Small graphics, such as those with overall dimensions of not greater than 12"×12" can generally be manufactured with satisfactory registration by those having requisite skill. However, this becomes much more difficult for larger graphic areas, and particularly for decorative items such as pin stripes which are common for the vehicle or automotive market.

Yet another approach which has been utilized is to apply the protective clear coat with a substantial oversize border to assure complete coverage of the graphic area. While this method achieves the required objective of protection for the graphic design, it is generally considered not to be aesthetic.

Although application of a protective clear coat by screen printing is a typical technique, other methods such as roller coating or spray coating may also be considered, providing a dry film thickness of about 0.6 mils is achieved.

Summarizing, an acceptable protective clear coat should be of sufficient thickness to provide adequate wearability and resistance to chemical environments, precisely cover the graphic area, whether same be large or small, and whether it be a simple geometric shape, such as a narrow width line, or a complex intricate design. Known techniques described above do not satisfy all these requirements.

Accordingly, the present invention provides exact registration of a clear protective coat over a graphic image; the protective coat has tapered, rounded and sloping edges which inhibits the buildup of wax and foreign matter at the edge portions, and looks integrated with the substrate; i.e., a paint-like look; the process can accomodate varying process tolerances, operator variability and equipment tolerances; the process provides a lenticular appearance on thin pin stripes, such as may be placed on vehicle surfaces; no kiss cutting or die cutting of the graphic is required; the graphic is defined by the printed graphic image, and the detail thereof is restricted to the image detail.

SUMMARY OF THE INVENTION

In accordance with the invention, there is a process provided for preparing a graphic pattern having a protective coating thereon in exact registration therewith. The process comprising (1) providing a carrier film having a major surface thereon, (2) applying an imaging composition on the major surface of the carrier, which has sufficient surface tension to wet the major surface to provide a film of the graphic pattern thereon, (3) drying the film of graphic pattern, (4) applying a liquid protective coating over the graphic pattern, and in substantial registration therewith, the protective coating composition having a surface tension sufficient to wet the graphic pattern but not the major surface of the carrier film and (5) drying the coating of protective material, whereby upon drying the protective overcoat dewets or retracts from the major surface of the carrier totally onto the graphic pattern, thus providing exact registration therewith.

DETAILED DESCRIPTION

The invention relates to a process for the manufacturer of a dry transfer graphic material, comprising the steps of applying to a substrate surface an image layer, typically comprising one or more layers of ink which form a graphic pattern thereon, and applying thereover, a protective clear coat, the clear coat being applied beyond the edge definition of the image areas, the surface energy of the substrate being sufficiently low relative to the surface tension of the protective clear coating that non-wetting by the protective coating occurs, and same therefor "creeps" back to the edge surface of the image areas.

The carrier or substrate upon which the image is placed is typiclly paper or polyester film with a low surface energy coating, such as silicone thereon. The carrier functions to provide a base surface having sufficient rigidity on which to print an image, the surface thereof having sufficient surface energy that it will permit a liquid imaging vehicle, while wet, to wet out and flow on the surface during image formation, yet has a sufficiently low comparative surface energy such that as the clear liquid protective top coat dries thereon, same will not wet, or will retract from the carrier surface onto the graphic image area. In addition, the low energy surface must allow for easy release of the graphic image therefrom, i.e., the adhesion of the graphic layer thereto should be releasable.

The imaging material can be comprised of conventional imaging materials used to form graphic images on substrates, such as inks, for example. The exact composition of the imaging material depends on the end use properties required. The imaging material is typically applied from a wet composition having surface tension properties such that the composition will wet out and flow on the carrier to create a visible printed pattern thereon. Imaging materials may be colored or colorless, although colored compositions are preferred. Conventional inks can be utilized, such as the vinyl or vinyl acrylic inks commercially available.

Screen printable inks can be classified on the basis of formation of the ink film, and the vehicles used for that film formation. For example, solvent-based inks form a film by evaporation of the various solvents contained therein, i.e., the wet film is dried. Curable inks provide a film which becomes polymerized through chemical change. Examples of inks include enamels; solvent-based inks, e.g., those containing lacquers and other solvents, poster inks, and water-based inks; those containing 100 percent solids, such as those based on epoxies, ultraviolet exposure systems, plastisols, etc.; and specialty inks, such as those which are expandable, those which exhibit electrical properties, etc.

To obtain good wetting, i.e., maximum surface contact on a carrier substrate, the surface tension of the ink must be equal to or less than the critical surface tension of the carrier film. In other words, the carrier surface must have a higher degree of surface wetability than the imaging composition.

Basically then, my invention relates to a process utilizing the surface tension characteristics of each of the three components of the process, i.e., the carrier surface, the imaging composition, typically screen printable inks, and the protective top coat. Usually, one begins with a determination of the critical solid surface tension of the carrier surface and then tailors the other two components to meet the requisite surface tension requirements. The surface energy of a film can be determined in a number of ways. For example, a series of liquids of known surface tension can be applied to a smooth test surface. The contact angle of these liquids on the solid surface is measured, and this information can then be plotted against the known surface tension of the respective liquids. Extrapolation of such data to a zero contact angle provides the solid surface tension, i.e., that of the carrier surface, since at this point the surface tension of the solid film is approximately equal to that of the liquid. This surface tension thus becomes the critical solid surface tension. When utilizing this procedure, with a silicone-based carrier surface was calculated to be 23.8 dynes/cm, which is in agreement with the reported literature value of 24 dynes/cm.

Similarly, results of contact angle measurements for liquids having known values of liquid surface tension due to dispersion forces and polar forces, both of which contribute to surface free energy can be utilized.

Finally, wetting tension test kits are commercially available to determine to critical surface tension of specific film substrates.

Once the critical solid surface energy of the carrier surface is known, an imaging composition can be tailored to appropriately wet the carrier surface sufficiently to provide or produce a good image. Specific solvents, surfactants, and other conventional and known additives can be utilized to modify the surface properties of the imaging composition, as desired.

Once the image is appropriately contained on the carrier surface, the clear protective top coat can be formulated based on solvent selection, particular resin, and other additives which together provide a formulation which is capable of wetting the dry image areas sufficiently, and yet not capable of wetting the carrier surface.

The protective top coat is made typically of a resinous film-forming material, an example thereof being aliphatic polyurethanes, which are conventionally utilized today to provide a protective top coat for a transfer graphic image. Because of the unique combination of characteristics in my article, the clear coat provides a variable high thickness over the surface of the graphic image, because the clear coat has surface tension properties such that when applied as a liquid, same is capable of flowing or wetting the dried image layer, yet retracting from the carrier onto the image layer sufficiently to protect it from chemicals and weathering, but not exceeding the exact boundary definition of the image.

In the process of the invention, a liquid imaging material is printed on a carrier, such as by screen printing, which allows the imaging composition to wet the carrier while it is in liquid form, and then allowed to dry or cure. Other imaging layers, such as of different colors, may also be printed in sequence if desired. The liquid top coat is then printed, as by screen printing, for example, over the image area, and slightly beyond the edge definition thereof, i.e., up to 0.050 inch, so as to assure complete coverage of the graphic image area. As this liquid coat dries, it will dewet, i.e., creep or retract from the carrier liner onto the image area where it has been overprinted, and can then be cured in conventional fashion.

The article can then be laminated to a conventional premask tape, i.e., a flexible film having a low tack adhesive thereon, whereupon the image area and overlying protective coat can be stripped away from the carrier liner, which can then be discarded. Once on the premask tape, the image areas can have an adhesive applied thereto for subsequent transfer to a substrate, such as the exterior surface of a vehicle.

In this manner, there is provided a low profile, high performance, durable graphic transfer system, having special utility in the automotive market place. For example, the invention can provide an automotive stripe or marking which is unique in appearance and performance properties, in that the graphics produced by the invention closely similate paint, a technique not heretofor available with a transfer graphic system.

The invention will now be further illustrated by the following example, wherein all parts are by weight unless otherwise specified.

EXAMPLE 1

A polyester film was coated with a composition of the following:

| | |
|---|---|
| SS-4191 (a 30 percent by weight solution of dimethyl polysiloxane | 15 |

-continued

| | |
|---|---|
| in silane) | |
| Toluene | 83 |
| SS-4259C (an accelerator) | 1.0 |
| SS-4192C (a silicone catalyst) | 1.0 |

(The foregoing all being commercially available from the General Electric Company).

The silicone-coated polyester was then screen printed with a 110 mesh screen, the composition thereof being as follows:

| | |
|---|---|
| "VYHH" resin (an 87 percent polyvinyl chloride/13 percent polyvinyl acetate copolymer, available from Union Carbide) | 22.0 |
| "Raven" 1200 (a carbon black pigment available from City Surface, Inc.) | 7.7 |
| Dioctyl phthalate | 4.3 |
| DB6006 (a silicone flow agent) | 3.0 |
| FC431 (a fluorocarbon flow agent) | 0.5 |
| Cyclohexanone | 31.25 |
| Isophorone | 31.25 |

The ink formulation was then further diluted with diisoamyl ketone to provide a viscosity of 1300 cps (using a Brookfield viscometer No. 3 spindle). After printing, the solvents were evaporated in an air convection oven at 50° C.

A protective clear coat was then prepared having the following formulation:

| Component | Description | Weight % |
|---|---|---|
| "Acryloid" Au 608S | Rigid acrylic polyol | 20.7 |
| "Desmophen" 670-90 | Flexible polyester polyol (Viscous liquid, 100% solids; equivalent wt. of 395; % hydroxyl of 4.3; available from Mobay Chemical, Inc.) | 41.3 |
| "Desmodur" N-100 | Aliphatic polyisocyanate (Viscous liquid, 100% solids; equivalent wt. of 190; % NCO of 22; available from Mobay Chemical, Inc.) | 23.7 |
| "Tinuvin" 292 | Hindered amine stabilizer (Available from Ciba Geigy, Inc.) | 0.7 |
| "Uvinul" N539 | Cyanoacrylate UV absorber (Available from BASF) | 1.1 |
| "Multiflow" | An acrylic copolymer resin solution 50% in xylene; specific gravity 25/25° C. of 0.925–0.940; refractive index at 25° C. of 1.481–1.485; available from Monsanto Industrial Chemicals Co.) | 1.4 |
| Fluorad-430 | Fluorocarbon flow additive Available from 3M Co.) | 0.8 |
| Dibutyl tin dilaurate | (10% solution in xylol) | 0.003 |
| Amsco Solv 1431 | Aromatic solvent having flash point of 150° F. (available from Union Chemical) | 10.3 |

The formulation was diluted with the "Carbitol acetate" to a viscosity of 500 cps (using a Brookfield viscometer No. 3 spindle).

This formulation was then screen printed in registration with the ink image previously prepared. The coating composition flowed readily through the screen and over the edges of the ink image.

The construction was then baked for 2 hours at 55° C. During drying, the coating composition dewetted back to the edge of the ink layer, thus providing excellent registration with the underlying ink areas.

What is claimed is:

1. A process for preparing a graphic pattern on a substrate having a protective coating thereover and in exact registration therewith, the process comprising:

(1) providing a carrier film having a major surface thereon;

(2) applying at least one coating of an imaging composition on said major surface, said imaging composition having a sufficient surface tension to wet said major surface of said carrier and provide a film of said graphic pattern thereon;

(3) drying said coating of imaging composition;

(4) applying a liquid protective coating over said graphic pattern, said coating being applied slightly beyond the edge definition of said graphic pattern and in substantial registration therewith; said protective coating having sufficient surface tension to wet said graphic pattern, but not said major surface of said carrier film; and (5) drying said coating of protective material; whereby during said drying said protective coating will dewet and retract from said major surface of said carrier onto said graphic pattern and provide exact registration with said graphic pattern.

2. The process of claim 1 wherein said carrier film is a polyester, and said major surface has a low surface energy coating thereon.

3. The process of claim 2 wherein said low surface energy coating is a silicone.

4. The process of claim 1 wherein said imaging composition comprises an ink.

5. The process of claim 4 wherein said ink is selected from the group consisting of vinyl and vinyl-acrylic inks.

6. The process of claim 1 wherein said protective coating composition comprises an aliphatic polyurethane.

7. The process of claim 1 further including the step of curing said protective overcoating after the drying thereof.

8. The process of claim 1 wherein said liquid protective coating is applied up to 0.050 inches beyond said edge definition of said graphic pattern.

* * * * *